United States Patent [19]

Babunovic

[11] 4,185,647

[45] Jan. 29, 1980

[54] CONTAINER CLEANING MACHINE

[75] Inventor: Momir Babunovic, Chesterfield, Mo.

[73] Assignee: Barry-Wehmiller Company, St. Louis, Mo.

[21] Appl. No.: 939,412

[22] Filed: Sep. 5, 1978

[51] Int. Cl.[2] ..... B08B 3/02

[52] U.S. Cl. ..... 134/60; 134/74; 134/104; 134/108; 134/152

[58] Field of Search ..... 134/60, 72–75, 134/104–105, 108, 130–131, 152, 183

[56] References Cited

U.S. PATENT DOCUMENTS

| | | | |
|---|---|---|---|
| 1,655,954 | 1/1928 | Herold | 134/60 |
| 2,681,872 | 6/1954 | McCabe | 134/60 X |
| 2,710,818 | 6/1955 | Winters | 134/74 X |
| 3,590,841 | 7/1971 | Reimers | 134/131 X |
| 4,094,329 | 6/1978 | Evans | 134/60 X |

FOREIGN PATENT DOCUMENTS

| | | | |
|---|---|---|---|
| 914832 | 7/1946 | France | 134/60 |

*Primary Examiner*—Robert L. Bleutge

*Attorney, Agent, or Firm*—Gravely, Lieder & Woodruff

[57] ABSTRACT

A container cleaning machine using hot caustic solution for cleaning containers and detaching labels in which the residual heat usually lost in the discharge end portion of the machine is conserved and put to use in the loading end portion of the machine by being released in a cascading film over the carriers and the containers for the purpose of prewarming the same whereby there is a significant reduction in the steam requirement and substantial quantities of heat usually lost to the sewer system are usefully employed.

12 Claims, 6 Drawing Figures

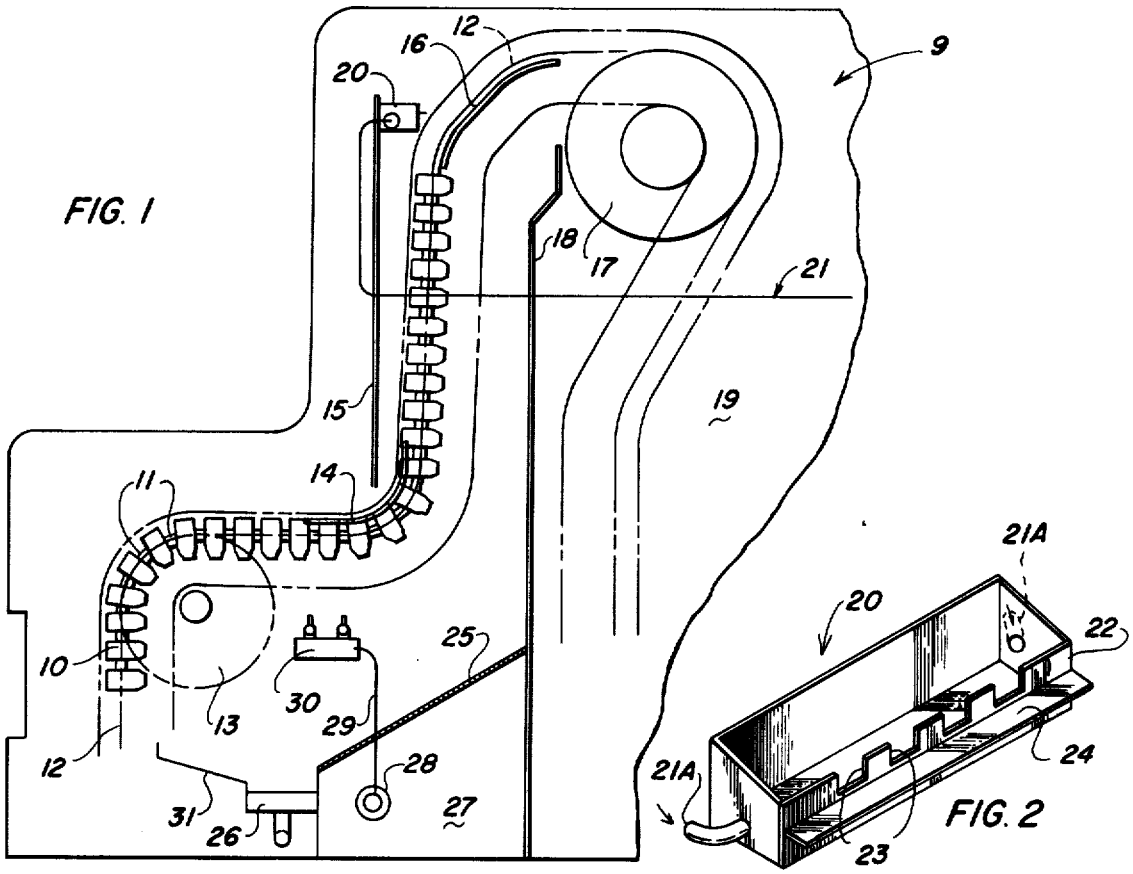
FIG. 1
9
12
16
20
18
17
21
19
15
14
11
10
13
30
29
25
28
27
31
26
12
21A
20
22
24
23
FIG. 2
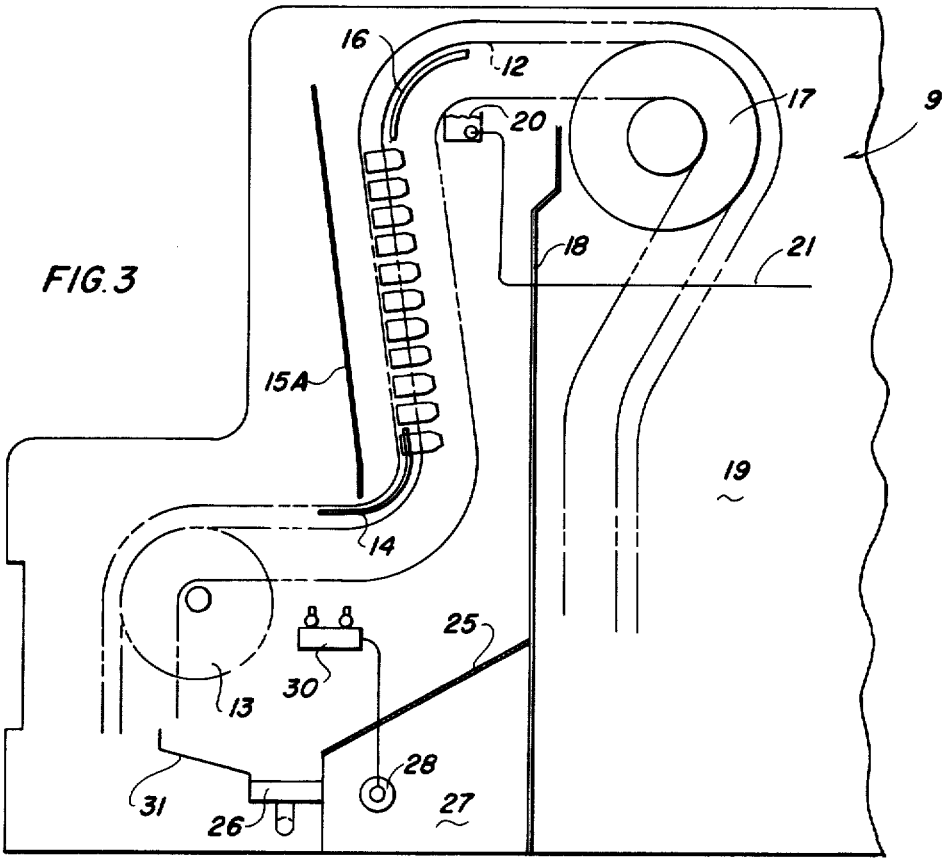
FIG. 3
16
12
20
17
9
18
21
15A
19
14
25
30
13
28
31
26
27

FIG. 4
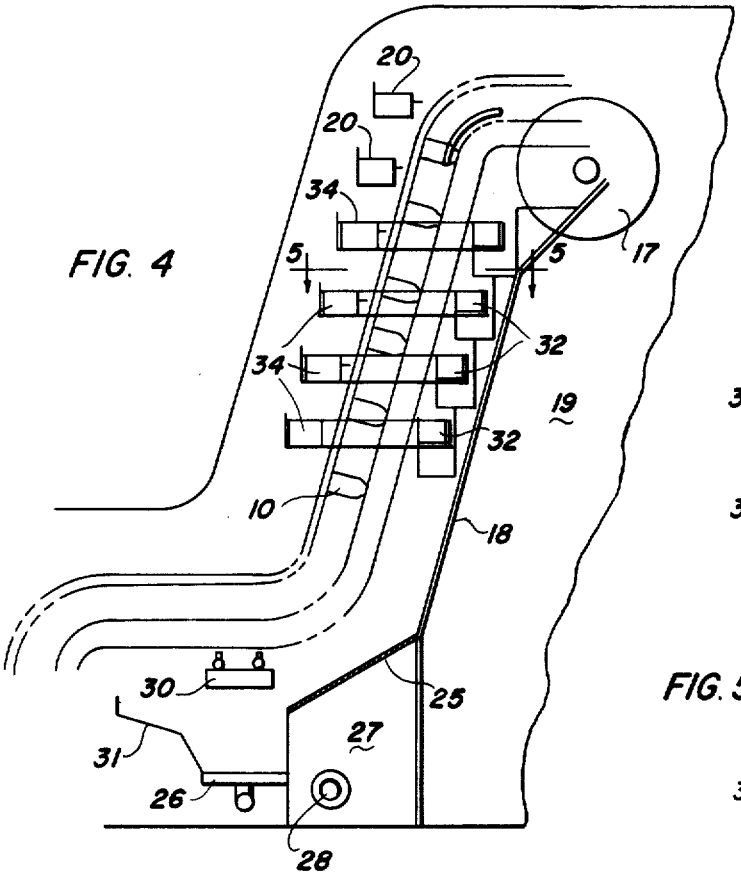
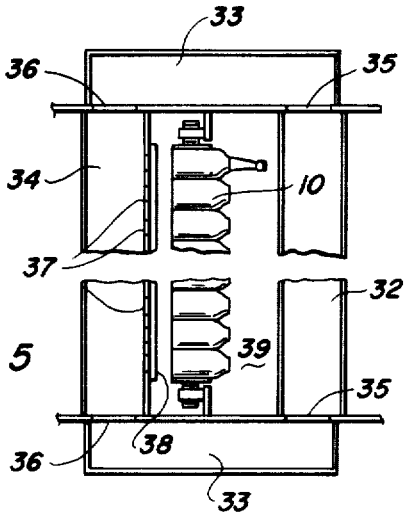
FIG. 5
FIG. 6
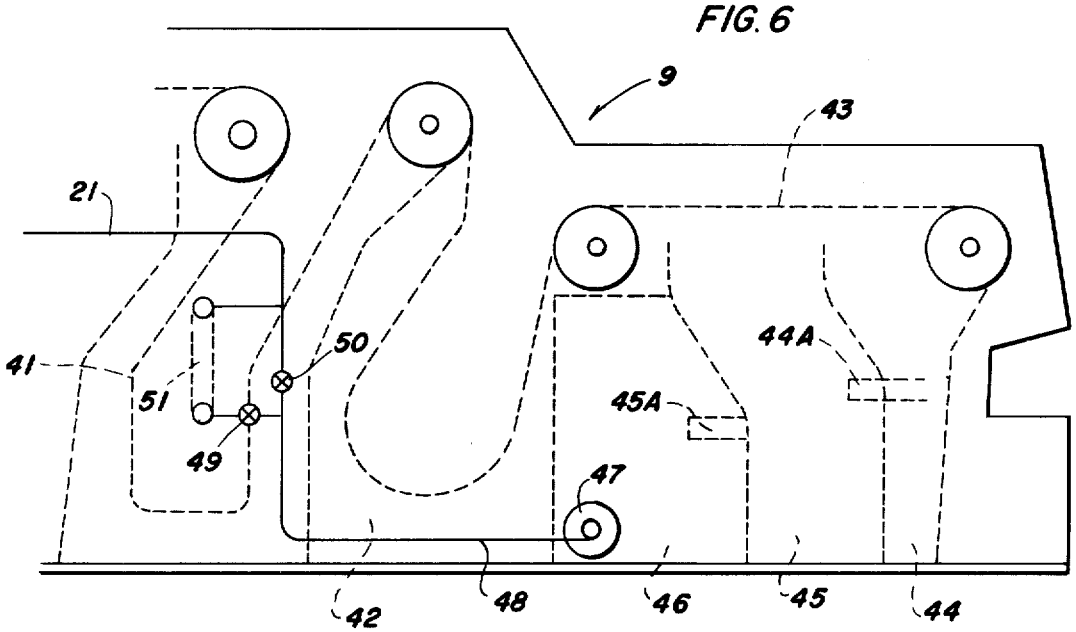

CONTAINER CLEANING MACHINE

BACKGROUND OF THE INVENTION

Container Cleaning Machine in recent years have grown in size to handle the volume of returnable containers that has come about due to attention given to wasteful practices of the past. In addition to increase in sizes of machines attention has been directed to the conservation of nonreplenishable fossil fuels and the rising cost of such fuels. Heat is required in these machines to remove labels and to attack and remove dirt and foreign objects in the containers. The consumption of heat in the usual cleaning or washing machines can be attributed to heating the carriers and conveyors, heating the containers, heat radiating losses, and heat losses to sewer discharges. Radiation loss may be reduced by use of insulation, but the size of the machines and the need for externally attached accessories makes insulation application a distinct problem. The heating of the conveyor and carriers is useful but calls for heat supply over and above that required to heat the caustic solution to its effective temperature level.

The conservation of fuels and the need for heat in cleaning machines presents problems which current generations of machines have not overcome. Some of the prior container cleaning machines have provided undershot jet sprays for containers entering the cleaning machine, in which the spray liquid is supplied from a compartment near the discharge end of the cleaning machine. However, the undershot spray arrangement does not effectively conserve the energy needed for producing the heated liquid supplied to the undershot spray.

BRIEF DESCRIPTION OF THE INVENTION

This invention relates to container cleaning machines, and particularly to an arrangement for effectively utilizing the heated liquid so as to conserve the use of fossil fuels in the production of heat for the liquid.

The objects of the invention are to provide means for utilizing the residual heat in the cleaning liquid for raising the temperature of the incoming containers, to provide means for cascading liquid containing residual heat values over the incoming carrier conveyors and the containers therein for raising the temperature of the containers in preparation for being subjected to progressively higher temperatures, and providing an arrangement in the cleaning machine which will transfer residual heat from the container discharge end portion to the container loading end portion for applying the heat to the container conveyor and carrier means.

The invention is embodied in a container cleaning machine having container loading and discharge end portions for respectively receiving and discharging containers moved through on a carrier conveyor, and including liquid cascading means disposed in the loading end portion for delivering a film of heated liquid over the conveyor carrier and the containers therein, where the heated liquid is obtained from means in the discharge end portion.

The embodiments representing the container cleaning machine of this invention include an arrangement of the cascading means in the container loading end portion which will maximize the contact time between the cascading film of liquid and the container conveyor carrier and containers.

The invention also embodies means for avoiding the need for an excessive number of accessory items in order to effectively supply the cascading means with liquid containing residual heat values.

BRIEF DESCRIPTION OF THE DRAWINGS

FIG. 1 is a fragmentary side view of the load end of a container cleaning machine showing the arrangement of cascading heated water over the incoming carriers and containers;

FIG. 2 is a perspective view of a typical pan for cascading the heated water;

FIG. 3 is a view similar to FIG. 1, but illustrating a modification in the direction of travel of the carriers and containers;

FIG. 4 is a further view similar to FIG. 1, but illustrating a multiple level cascading arrangement for the heated water;

FIG. 5 is a plan view of a typical pan suitable for effecting the multiple cascade seen in FIG. 4; and FIG. 6 is a fragmentary side view of the discharge end of a container cleaning machine showing transfer of the heat from the containers and carriers to the cascade at the load end.

DESCRIPTION OF THE EMBODIMENTS

The various forms of the container cleaning machine to be described are all directed to the concept of conserving energy by using the heat values in the washing solution or water circulated in a cleaning machine rather than wasting the heat which has been the general practice in the past.

In FIGS. 1 and 2 there is shown the essential components of one embodiment of this invention disposed in the container load end of a cleaning machine 9. The containers are placed by means, not shown, in a conveyor having multiple pockets in suitable carriers 10 by which the containers are moved along by a conveyor chain 11 following the chain pitch path 12 over a driven sprocket 13 and into a short horizontal travel before being directed by a shaped track 14 into a generally vertical path inside a wall 15. The upper end of the latter path is diverted by a suitable guide 16 so the chain passes over a driven sprocket 17 before descending over a wall 18 into compartment 19.

As the conveyor carriers 10 and the containers are moved vertically upwardly from the guide track 14, a cascade of heated liquid is delivered thereon from a cascade pan 20 suitably positioned to deliver its liquid onto the upper carriers for gravity flow down over following carriers. The liquid arrives at the pan 20 by a pipe 21 and split ends 21A from a source of liquid to be described presently. The pan 20 is formed with a low front wall 22 having a plurality of slots 23 opening onto a distribution plate 24 which spreads the liquid over its length for substantially even distribution over the carriers 10 and the containers in the respective pockets. The liquid gives up a substantial portion of its heat to elevate the temperature of the carriers and containers from the temperature at the load end adjacent sprocket 13. The liquid descends upon a screen 25 where loose trash is washed off to the sump 26 and disposed of. The screened liquid is collected in compartment 27 and moved by pump 28 and conduit 29 to spray means 30 where the passing containers with the mouths down are hit with jets of liquid before the liquid is collected in the pan 31 and directed into the sump 26.

A modification of the foregoing assembly is seen in FIG. 3 where like parts and elements from FIGS. 1 and 2 will be designated by similar reference characters. The essential change is in moving the upper guide 16 so it is aligned over the guide 14, and in slanting the wall 15A backwardly. This rearrangement allows the cascading liquid from the pan 20 to more thoroughly bathe the carriers 10 and the containers, whereby the heating value of the liquid is more fully transferred.

A further modification is seen in FIGS. 4 and 5 in which multiple cascade means is provided to deliver heated liquid over the ascending carriers 10 and containers. The arrangement of components follows that previously described, except that the ascending path of the conveyor 11 is slanted forwardly so the conveyor approaches the upper drive sprocket 17 more closely, and the compartment wall 18 is slanted to approach the sprocket 17.

The liquid cascade is formed by the placement of pans 20 in overlapped positions to deliver the heated liquid by two cascades in off set positions. Below the lower pan 20 there are a series of means having catch basins 32 in off set relation to follow the slope of the conveyor 11 between the lower guide 14 and upper guide 16. The slope may be at an angle of the order of about 70° from the horizontal. A typical catch basin 32 is seen in FIG. 5 to comprise the basin 32 connected at its opposite ends by transfer channels 33 which extend to a modified cascade pan 34. The basin end walls are notched at 35 to allow liquid to spill into channels 33. The channels 33 are slanted in a direction to force the liquid to flow through notches 36 into the pan 34. The front wall of pan 34 is formed with a plurality of notches 37 for delivering the liquid onto a distribution plate 38 from which a cascade can form and fall onto the carriers 10 and containers as they rise through the open space 39 between basin 32, pan 34 and channels 33. The basin 32 in each of the cascade means is set to be higher than the cooperating pans 34 so the liquid will flow by gravity into the pans 34. Also it is observed that the cascade pans 34 deliver the liquid in such a manner that the carriers and containers are bathed by the liquid, and the liquid is directed generally toward the catch basin 32 next below it. the angle of the order of 70° is selected to contribute to the movement of the liquid successively from catch basin 32 at a higher elevation into its associated pan 34 and then to the next lower catch basin 32. The liquid thus collected and cascaded in successive stages effects an efficient transfer of its heat to the carriers 10 and containers therein. The final cascade delivers the liquid onto the screen 25 where it is substantially freed of trash and pumped by pump 28 to the jet sprays at means 30.

The source of the liquid flowing in conduit 21 is shown schematically in FIG. 6. The discharge end portion of the cleaning machine 9 is formed with a post soak compartment 41 to which the conveyor brings the carriers 10. The heat picked up by the carriers and containers may be at a level of the order of 180° F., and that heat is imparted to the liquid in that compartment 41. The carriers 10 move on to the last post soak compartment 42 where further heat is given up to the liquid in that compartment, so the liquid takes on a temperature of the order of 120° F. As the carriers 10 reach the conveyor pass 43 liquid sprays (not shown) are formed to further reduce the container temperature in preparation for discharge to the outside at a manageable temperature. The spray liquid is collected in compartments 44 and 45 and passed from one to the other through spill ways 44A and 45A, and eventually into the compartment 46. A pump 47 moves the collected liquid, which may have an average temperature of the order of 80° F., into conduit 48. The conduit leads to a pair of controllable valves 49 and 50 where part of the liquid can be diverted by valve adjustment into a heat transfer coil 51 where the liquid can be elevated in temperature by picking up heat imparted to the liquid surrounding the coil 51 from the incoming heated carriers and containers. The transfer of the heat to the liquid delivered to conduit 21 is directed to the load end of the washer apparatus where, as in FIGS. 1, 3 or 4, a thin cascading film of liquid is delivered over the carriers and the containers for a maximum heat transfer effect.

In the foregoing description it will be understood that the liquid supplied to the cascading means will be collected at pump 47 from compartment 44 which is formed with a spill-way 44A communicating with compartment 45 which, in turn, is provided with a spill-way 45A to supply liquid to the compartment 46 connected with the pump 47. The pump delivers its liquid through conduit 48 to a post soak compartment 41 containing caustic solution which is raised in temperature due to the heat retained in the conveyor carriers and the containers. The retained heat is imparted to the solution in compartment 41 and is used as the source of heat through the exchanger coil 51 to supply heat to the liquid moved in conduit 21 which is connected into the cascading means.

While the prior art provides spray nozzles, in the zone adjacent the container loading end, such nozzles are highly subject to plugging in view of the contamination of the liquid in compartments in the discharge end of the machine. Such contaminants include fine paper which is normally carried over by sticking to the conveyor carriers. The problem of nozzle plugging is overcome by providing open slot cascading means 20 which cannot possibly plug and which will at all times permit a free flow of the heated liquid. The cascading means is formed to substantially match the side to side dimension of the conveyor carriers so that the liquid will be effectively distributed across the width of the carriers so as to reach all containers. The utilization of the above-described cascading means will raise the temperature of the containers and the conveyor carriers, prior to introduction to the first pre soak compartment, to a level that will effect a saving in energy of approximately 20% over currently existing machines. It is advantagious to utilize the controllable valves 49 and 50 associated with exchanger coil 51 because of the seasonal change in fresh water temperatures introduced to the final rinse compartment in the discharge end.

While the foregoing description has presented certain modifications of means for cascading liquid containing residual heat over the incoming containers and the carriers therefor, it is to be understood that further modifications may be made without materially changing the scope of the disclosure.

What is claimed is:

1. A container cleaning machine using a heated liquid cleaning medium and comprising an endless conveyor having pockets for supporting the containers during cleaning, a container loading end portion, a container discharge end portion, said endless conveyor moving containers between said loading and discharge end portions, said endless conveyor in the loading end portion being directed to move along a rising path in which said pockets and the containers therein are in generally superposed relation, liquid cascade means mounted in fixed position adjacent said rising path of movement of said endless conveyor for directing liquid upon said endless conveyor pockets and the containers therein in opposition to the direction of travel of the conveyor pockets, and liquid collecting and moving means in the discharge end portion connected to said liquid cascade means for delivering liquid to said liquid cascade means at a heat acquired in said discharge end portion, said heat in the liquid being imparted to the pockets and containers in said rising path of said endless conveyor.

2. The container cleaning machine set forth in claim 1, wherein said conveyor moving in said loading end portion in said rising path is directed upwardly at an angle to the vertical, and said liquid cascade means is disposed adjacent the upper end of said rising path of movement of said endless conveyor for distributing liquid over said conveyor and the containers.

3. The container cleaning machine set forth in claim 1, wherein said cascade means is a single pan having liquid overflow means for releasing the heated liquid in a film spread over said endless conveyor and the containers in said pockets.

4. The container cleaning machine set forth in claim 1, wherein said cascade means comprises a series of overlapping pans spaced along the rising path of said conveyor and a catch basin associated with each of said pans and in position to collect falling liquid from the higher pan and conduct it to the associated pan.

5. The container cleaning machine set forth in claim 1, wherein said conveying means in said loading end portion is movable in said rising path having an upwardly and forwardly slanted direction, and said cascade means includes a plurality of pans in spaced relation along said slanted path and liquid catch basins connected in liquid flow relation to certain of said pans.

6. The container cleaning machine set forth in claim 1, wherein said conveyor moving in said loading end portion along said rising path is angled backwardly on itself relative to a vertical, said liquid cascade means is disposed adjacent said angled conveyor rising path, and splash wall means is disposed adjacent said backwardly angled conveyor rising path.

7. In a container cleaning machine using liquid cleaning medium at different levels of heat between a loading end and a discharge end, the improvement comprising: an endless conveyor having pockets for moving containers to be cleaned between the loading and discharge ends, said conveyor having a path of movement that rises above said loading end in a generally vertical direction; liquid distribution pan means fixed adjacent said rising path of movement, said pan means having liquid overflow distribution means at a position to spread the liquid by gravity effect over the conveyor pockets and containers such that a plurality of pockets and containers in series in said rising path are bathed in the liquid moving in counter flow relation; means adjacent the discharge end of the machine for collecting liquid cleaning medium having a predetermined level of heat; and means operatively connecting said collecting means and said distribution pan means for delivering the liquid cleaning medium to said distribution pan means whereby the predetermined level of heat in the liquid cleaning medium tempers the pockets and containers therein.

8. In the container cleaning machine of claim 7, the provision wherein said liquid distribution pan means consisting of a series of vertically spaced and overlapping catch basins and interconnected pans spaced apart to define an open space for passage of said endless conveyor and container loaded pockets, said connection between said catch basins and pans transferring liquid for flow through said overflow distribution means.

9. In a container cleaning machine using heated liquid cleaning medium and including conveyor means having pockets for supporting the containers during cleaning, container loading end and discharge end portions for said machine, said conveyor means moving containers between said loading and discharge end portions and adjacent said loading end portion moving the containers in said pockets along a rising path in which said pockets are one higher than another so as to be in generally superimposed relation, the improvement comprising: cascade means for the liquid cleaning medium positioned adjacent the rising path of said conveyor means for directing the liquid cleaning medium downwardly upon said conveyor pockets and the containers therein; liquid collecting and moving means adjacent said discharge end portion and connected to said cascade means for delivering the collected liquid thereto at a heat level acquired at said discharge end; and means adjacent said loading end for collecting the liquid cleaning medium from said cascade means and delivering it for initially cleaning the containers moved by said conveyor pockets in advance of said cascade means to utilize residual heat in the liquid cleaning medium leaving said cascade means.

10. The container cleaning machine set forth in claim 9, wherein said conveyor moving in said loading end portion in said rising path is directed upwardly at an angle to the vertical, and said liquid cascade means is disposed adjacent the upper end of said rising path of movement of said conveyor for distributing liquid over said conveyor and the containers.

11. The container cleaning machine set forth in claim 9, wherein said cascade means is a single pan having liquid overflow means for releasing the heated liquid in a film spread over said conveyor and the containers in said pockets.

12. The container cleaning machine set forth in claim 9, wherein said cascade means comprises a series of overlapping pans spaced along the rising path of said conveyor and a catch basin associated with each of said pans and in position to collect falling liquid from the higher pan and conduct it to the associated pan.

* * * * *